US008464833B2

(12) United States Patent
Lee

(10) Patent No.: US 8,464,833 B2
(45) Date of Patent: Jun. 18, 2013

(54) ADJUSTABLE HANG LADDER WITH FALL ARRESTING AND CUSHIONING ARRANGEMENT

(76) Inventor: Ge Lee, Oshkosh, WI (US)

( * ) Notice: Subject to any disclaimer, the term of this patent is extended or adjusted under 35 U.S.C. 154(b) by 230 days.

(21) Appl. No.: 12/898,096

(22) Filed: Oct. 5, 2010

(65) Prior Publication Data

US 2012/0080263 A1 Apr. 5, 2012

(51) Int. Cl.
*E06C 7/18* (2006.01)

(52) U.S. Cl.
USPC ..... 182/8; 182/45; 182/207; 182/233

(58) Field of Classification Search
USPC ..... 182/3, 233, 8, 45, 197, 207, 214
See application file for complete search history.

(56) References Cited

U.S. PATENT DOCUMENTS

| | | | | | |
|---|---|---|---|---|---|
| 91,039 | A | * | 6/1869 | Phillips | 182/25 |
| 434,176 | A | | 8/1890 | Crafts | |
| 836,785 | A | | 11/1906 | Shumaker | |
| 1,160,721 | A | | 11/1915 | Kessler | |
| 1,340,492 | A | | 5/1920 | Melanson | |
| 1,470,489 | A | * | 10/1923 | Schuh | 248/694 |
| 1,894,489 | A | * | 1/1933 | Hirose et al. | 182/23 |
| 2,341,510 | A | | 2/1944 | Born | |
| 2,426,825 | A | * | 9/1947 | Geary | 248/237 |
| 2,439,430 | A | | 4/1948 | Hurd | |
| 2,556,998 | A | | 6/1951 | Frazier | |
| 2,781,158 | A | | 2/1957 | Raitt | |
| 3,554,318 | A | * | 1/1971 | Knight | 182/24 |
| 4,102,433 | A | * | 7/1978 | Van Valkenburgh | 182/164 |
| 4,179,011 | A | | 12/1979 | Morawski | |
| 4,182,431 | A | * | 1/1980 | Wing | 182/23 |
| 4,311,207 | A | | 1/1982 | Lurry | |
| 4,371,055 | A | * | 2/1983 | Ashton et al. | 182/46 |
| 4,423,796 | A | * | 1/1984 | Sulowski et al. | 182/8 |
| 4,678,061 | A | | 7/1987 | Jordan et al. | |
| 4,709,783 | A | * | 12/1987 | Tomioka et al. | 182/8 |
| 4,765,439 | A | * | 8/1988 | Kresmery | 182/107 |
| 4,787,478 | A | | 11/1988 | Stakes | |
| 4,938,312 | A | | 7/1990 | Trail | |
| 4,951,780 | A | * | 8/1990 | Kim | 182/27 |
| 5,163,532 | A | * | 11/1992 | McCarty | 182/163 |
| 5,497,848 | A | | 3/1996 | Travis | |
| 5,636,704 | A | | 6/1997 | Castaneda | |
| 5,908,083 | A | * | 6/1999 | Hamilton | 182/45 |
| 6,092,624 | A | * | 7/2000 | Slater | 182/45 |
| 6,112,853 | A | * | 9/2000 | Beard | 182/45 |
| 6,161,647 | A | | 12/2000 | Braden et al. | |
| 6,220,389 | B1 | * | 4/2001 | Krause | 182/23 |
| 6,457,556 | B1 | | 10/2002 | Skade et al. | |
| 6,513,625 | B1 | | 2/2003 | Gaskins | |

(Continued)

FOREIGN PATENT DOCUMENTS

DE 3719403 A1 * 12/1987

*Primary Examiner* — Alvin Chin Shue
*Assistant Examiner* — Colleen M Chavchavadze
(74) *Attorney, Agent, or Firm* — Andrus, Sceales, Starke & Sawall, LLP

(57) ABSTRACT

An adjustable hang ladder includes a main ladder section and a hang ladder section secured to the main ladder section. The hang ladder section has a hang ladder insert pivotally secured to an attachment section and locked in place by a locking mechanism. The hang ladder section is provided with a fall arresting and damping arrangement designed for connection to a roofer using the ladder for providing a cushioning effect in the event the roofer falls from the ladder.

9 Claims, 5 Drawing Sheets

U.S. PATENT DOCUMENTS

| | | | | |
|---|---|---|---|---|
| 7,028,809 | B2 * | 4/2006 | Dudschus | 182/214 |
| 7,044,270 | B1 * | 5/2006 | McIntire et al. | 182/206 |
| D578,867 | S * | 10/2008 | Deuer | D8/354 |
| 7,556,125 | B1 | 7/2009 | Blehm | |
| 2006/0000674 | A1 * | 1/2006 | McIntire et al. | 182/129 |
| 2010/0326768 | A1 * | 12/2010 | Kerstetter, Jr. | 182/5 |

* cited by examiner

ADJUSTABLE HANG LADDER WITH FALL ARRESTING AND CUSHIONING ARRANGEMENT

FIELD

The present invention relates generally to ladders and, more particularly, pertains to roofing ladders primarily intended for extending over the ridges or peaks of inclined roofs to be adjustably secured thereon.

BACKGROUND

In the performance of their occupation, workmen, such as roofers, painters, carpenters and the like, are required at times to perform their work on inclined roofs. To work on highly pitched roofs, it is necessary that the workman position some type of support, such as a ladder, or scaffold, on the roof. When the job is not too extensive, a section of a conventional extension ladder is often employed wherein the ladder is supported in an inclined position on the roof with the lower end of the ladder engaging a gutter at the lower end of the roof. This arrangement results in a hazardous condition since the gutter is liable to become detached from the roof allowing the ladder to slide downwardly thereon. To overcome this problem, it has been proposed to provide ladders with hooks for engaging the ridge of the roof. While these hook assemblies have been satisfactory for their intended purpose, they have been subject to certain disadvantages, such as being integrally connected to the ladder, thereby rendering the ladder cumbersome when using the ladder on other jobs not requiring the hook assembly. Also, many of the hooks are not adjustable for properly engaging ridges of roofs of different pitches. Some of these devices also tend to damage the roofs and thereby render such use prohibitive.

Other related prior art has attempted to provide pivoting ladder attachments that secure a ladder on an inclined roof, but these designs have been found to be complex to assemble and disassemble or difficult to adjust.

Work on roof surfaces always poses an inherent danger due to the fact that most homes and buildings utilize pitch roofs. Various methods and devices have been used by roofers to promote safety, and provide a means for protecting a roof workman in the event of a fall from the ladder. Some of these methods include the use of ropes and other safety catching devices which provide security against a dangerous fall to the ground, but do not adequately address the impact caused by the fall energy and sustained by a worker who has fallen from the ladder.

Accordingly, it is desirable to provide a hang ladder that can be easily adjusted and locked in place for use on variously inclined roofs. It is further desirable to provide such ladder with a fall arresting and damping arrangement which will enhance the safety of the worker utilizing the ladder.

SUMMARY

The present disclosure relates to an adjustable ladder adapted to be used by a roofer on an inclined roof. The ladder includes a main ladder section having an outer ladder and an inner ladder slidably received relative to the outer ladder so that the inner ladder is movable between retracted and extended positions relative to the outer ladder to change the length of the main ladder section. The inner ladder is selectively locked relative to the outer ladder by a first locking mechanism on the outer ladder. The outer ladder and the inner ladder each have side rails interconnected by a plurality of rungs. A hang ladder section has an attachment section secured to an upper end of the outer ladder and a hang ladder insert pivotally attached to the attachment section so that the hang ladder insert is movable to various angular positions relative to the attachment section. The upper end of the attachment section is provided with a second locking mechanism for fixing the hang ladder insert at a particular angular position relative to the attachment section. The attachment section and the hang ladder insert both have side rails interconnected by a plurality of rungs. A fall arresting and resilient damping arrangement is fixedly mounted on the hang ladder section and designed for connection to the roofer for providing a cushioning effect in the event the roofer falls from the ladder.

The outer ladder is provided with spacers adapted to space the main ladder section from the roof. A bottom end of the inner ladder is provided with foot pegs adapted to engage a gutter on a roof. The side rails of the hang ladder insert are provided with extensions adapted to receive a retaining member which is transversely positioned across the extensions and attached to the roof. The fall arresting and damping arrangement includes a cushioning cylinder assembly movable between extended and retracted positions. The cushioning cylinder assembly is attached to a mounting plate interconnected between the side rails of the attachment section. The cushioning cylinder assembly is further attached to a pair of mounting braces fixed to the side rails of the attachment section. The cushioning cylinder assembly is located on the attachment section beneath the second locking mechanism. The cushioning cylinder assembly includes a housing having an open end, a spring arrangement contained in the housing, an extendible and retractable rod passing through the spring arrangement and having an eye hook at one end of the rod and a cap connected to the open end of the housing for retaining the spring arrangement and the rod in the housing with the eye hook extending outside the cap. The cushioning cylinder assembly is located between the second locking mechanism and an uppermost rung of the main ladder section.

BRIEF DESCRIPTION OF THE DRAWINGS

The best mode of carrying out the invention is described herein below with reference to the following drawing figures.

DETAILED DESCRIPTION

Figure 1:
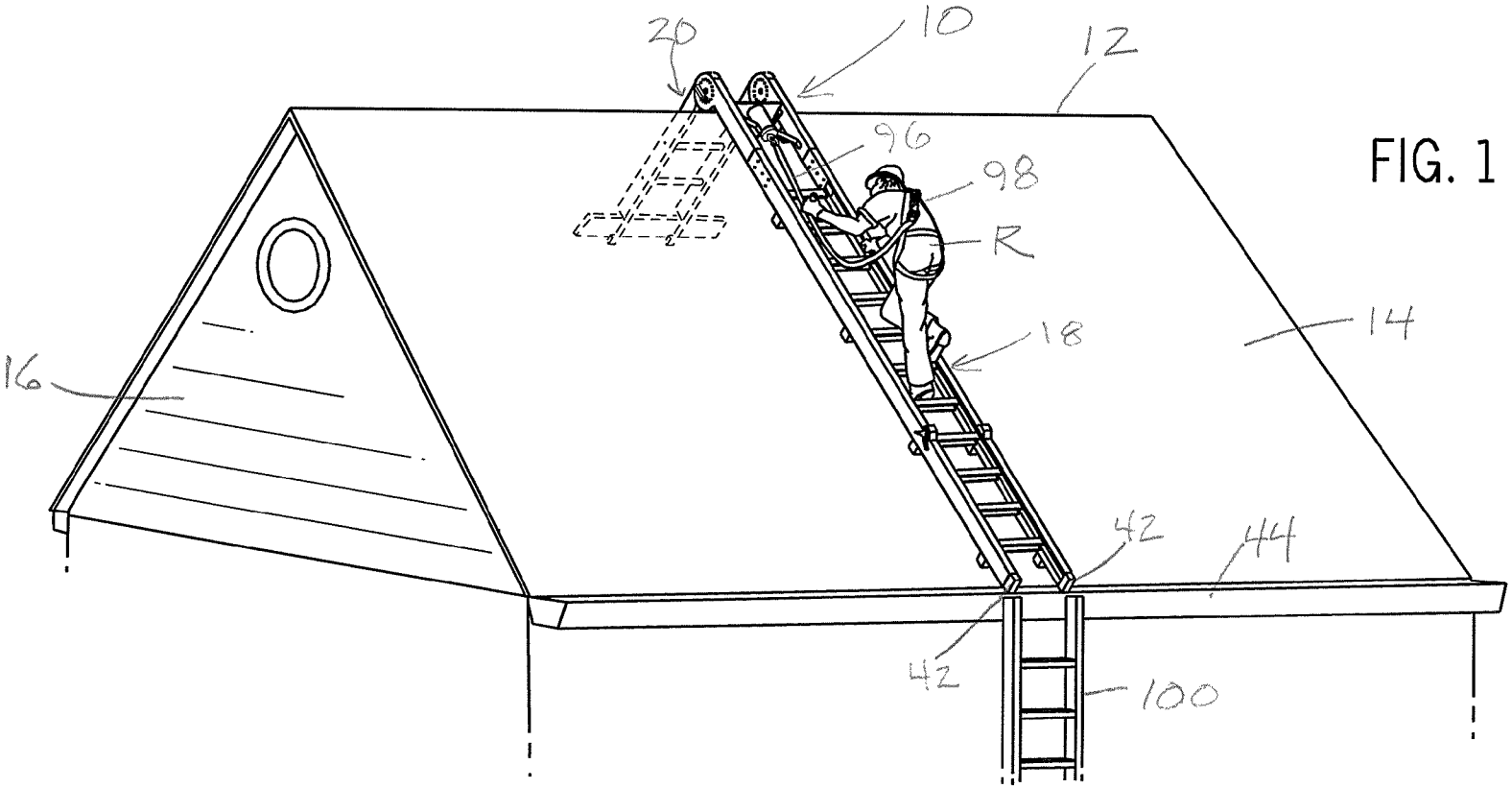
FIG. 1 is a representation of an adjustable hang ladder in accordance with the present disclosure in use on an inclined roof of a house.

Referring now to the drawings, FIG. 1 illustrates a roofer R stationed on an adjustable hang ladder 10 in accordance with the present disclosure. The ladder 10 is positioned on both sides and over a peak 12 of an inclined roof 14 of the home or other similar building 16, and used to facilitate roofing work in a safe and efficient manner for roofers, as well as painters, carpenters, inspectors and the like.

Figure 2:
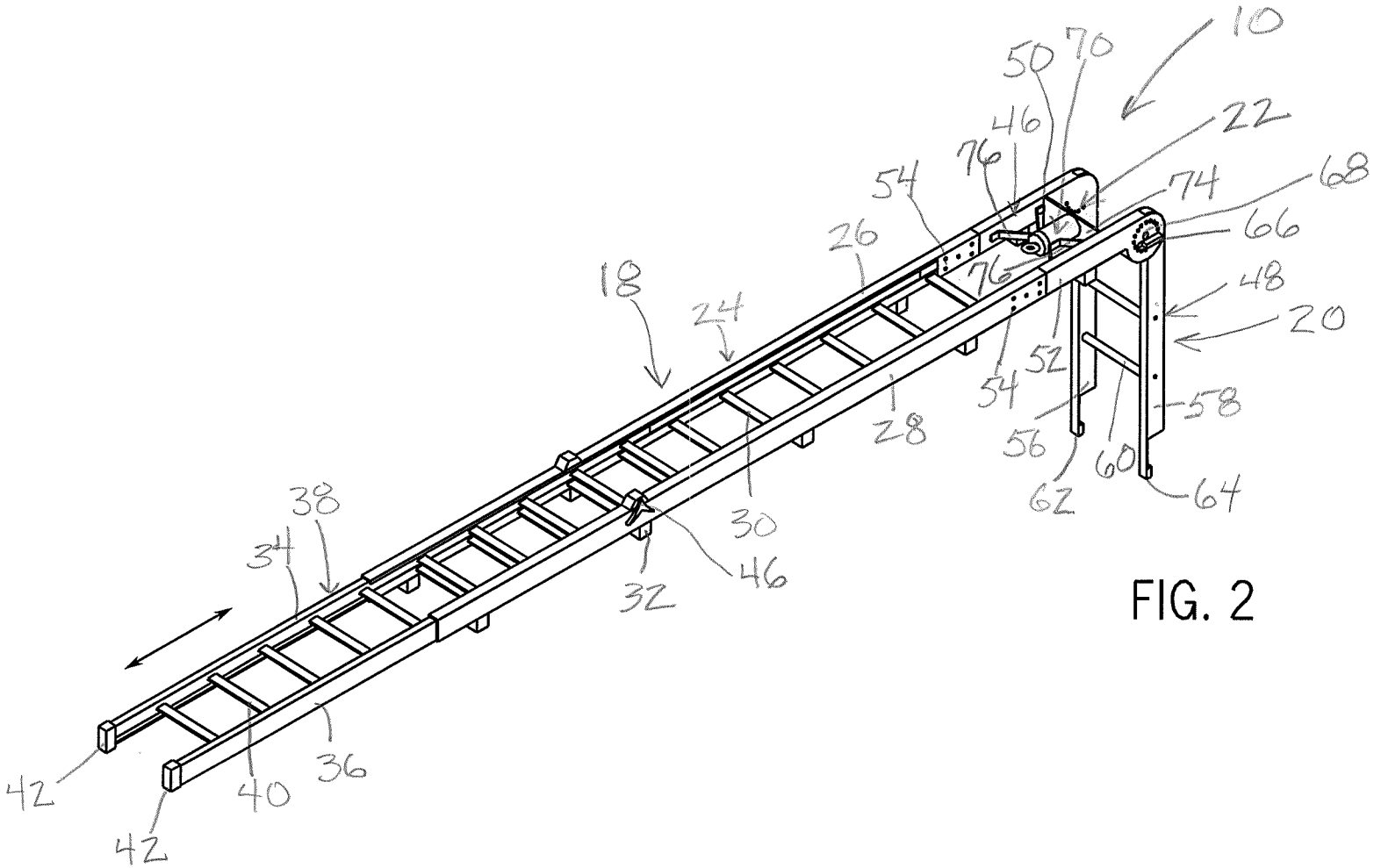
FIG. 2 is a perspective view of the hang ladder shown in FIG. 1.

As seen in FIG. 2, the ladder 10 is comprised of a main ladder section 18, a hang ladder section 20, and a fall arresting and damping arrangement 22. In the example described, the ladder 10 is preferably formed of a lightweight, durable metal, such as aluminum or the like, which is sturdy, weather resistant and easy to transport and handle.

The main ladder section 18 includes an outer ladder 24 having a pair of side rails 26, 28 interconnected by a plurality of rungs 30. A set of spacers 32 projects from the bottom surfaces of the side rails 26, 28 and protectively engages the roof 14 when the ladder 10 is in use. The side rails 26, 28 of the outer ladder 24 are constructed with a C-shaped cross section designed to telescopically receive side rails 34, 36 of an inner ladder 38 with the side rails 34, 36 interconnected by rungs 40. Lower ends of the side rails 34, 36 are provided with foot pegs 42 which can protectively engage a gutter 44 (FIG. 1) when the ladder 10 is in use on the roof 14. A first locking mechanism 46 is included on the outer ladder 24 and used to selectively lock and release the inner ladder 38 relative to the outer ladder 24 so as to provide the main ladder section 18 with a variable length adjustment depending on the length from the roof peak 12 to the gutter 44.

The hang ladder section 20 is attached at an upper end of the outer ladder 24, and is comprised of an attachment section 46 and a hang ladder insert 48. The attachment section 46 includes a pair of attachment side rails 50, 52 that are slidably received and fixed, such as by fasteners 54, in the upper ends of the side rails 26, 28. The attachment side rails 50, 52 effectively extend the length of the outer ladder 24 and provide a support structure for the fall arresting and damping arrangement 22 to be further described below. Outer ends of the attachment side rails 50, 52 are enlarged to pivotally receive upper ends of side rails 56, 58 of the hang ladder insert 48. The side rails 56, 58 are joined by rungs 60 and have lower ends provided with extensions 62, 64 used to positively secure ladder 10 to the roof 14.

Outer ends of the attachment side rails 50, 52 are provided with a second locking mechanism 66 for selectively locking and unlocking the hang ladder insert 48 in various positions relative to the attachment section 46. The second locking mechanism 66 enables the hang ladder insert 48 to be pivoted at pivot axis 68 typically over a range of about 90° so that the ladder 10 can be quickly secured over the peak 12 of the roof 14 at the desired angular setting depending on the particular incline of the roof 14.

Figure 5:
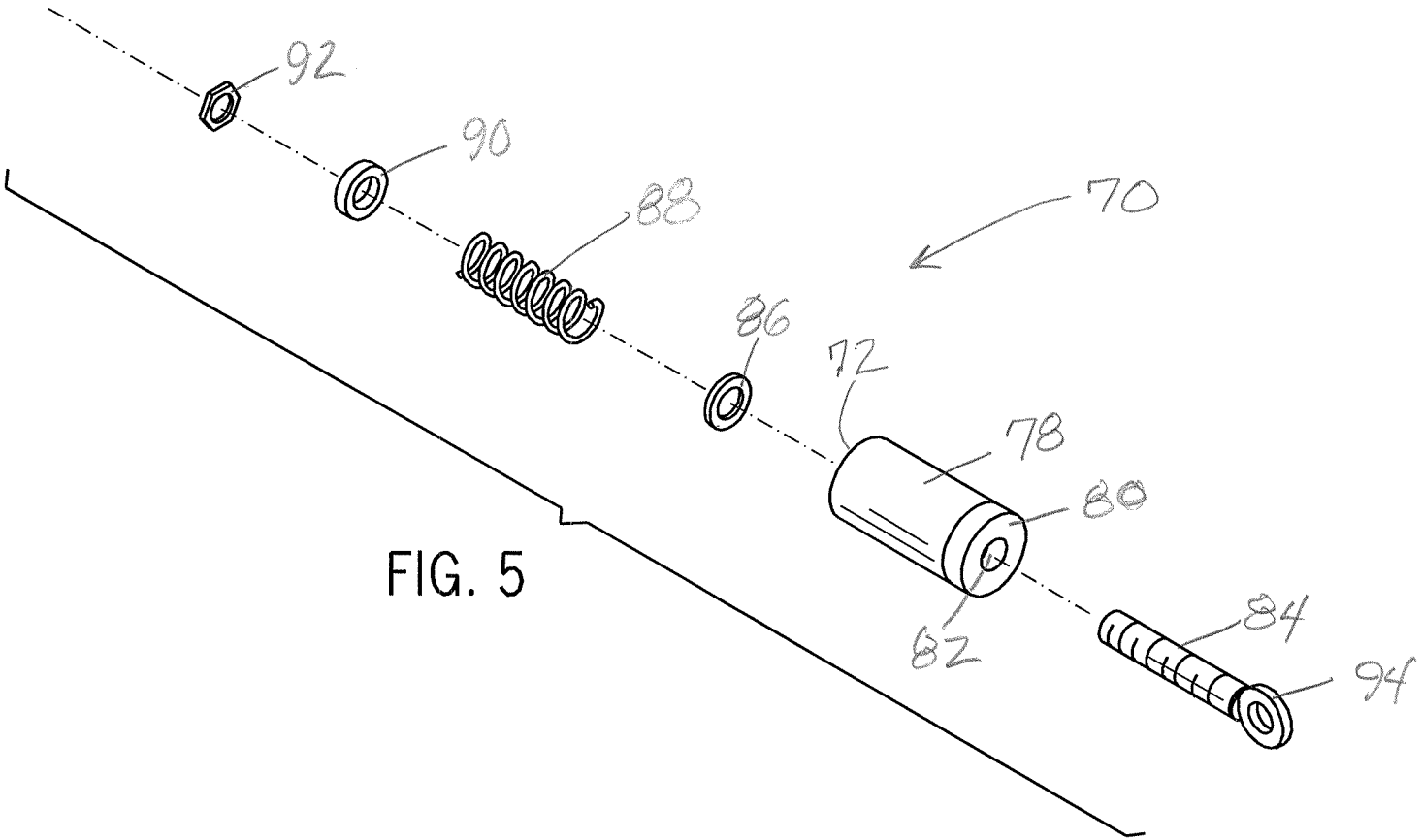
FIG. 5 is an exploded view of a cushioning cylinder assembly used in a fall arresting and damping arrangement in FIGS. 1 and 2.

The fall arresting and damping arrangement 22 serves to protect the roofer R or the like connected thereto in the event of a fall from the ladder 10 when in use so that the roofer R does not fall from the ladder 10 to the ground. Referring to FIGS. 2 and 5, the fall arresting and damping arrangement 22 has a cushioning cylinder assembly 70 movable between extended and retracted positions and a base 72 fixed to a mounting plate 74 interconnected between attachment side rails 50, 52. Opposite outer surfaces of the cylinder assembly 70 are secured to the inside of side rails 50, 52 by a pair of identical support braces 76. The cylinder assembly 70 is thus located between the second locking mechanism 66 and an uppermost rung of the main ladder section 18. As seen in FIG. 5, the cylinder arrangement 70 includes a cylinder housing 78 having an open outer end closed by a cap 80 having a central opening 82 formed therein. The capped cylinder 78 is designed to retain an extendible and retractable harness rod 84 which passes through an upper washer 86, a coil spring 88, and a lower washer 90 and has a threaded lower end screwthreaded into a lock nut 92. The harness rod 84 extends through the central opening 82 and has an outer end provided with an eye hook 94 that normally protrudes from the cap 80 while the remainder of the cylinder assembly 70 remains inside the cap cylinder 78.

It should be appreciated that, with this construction, a lanyard 96 (FIG. 1) is connected between the eye hook 94 and a harness 98 typically worn by the roofer R or other individual positioned on the ladder 10. In the event the roofer R should slip from the ladder 10, the fall energy of the roofer R will extend the rod 84 and compress spring 88 so as to damp or cushion the fall of the roofer R normally adjacent the side of the ladder 10, and prevent a sudden fall hanging impact. As a roofer R recovers from the fall and remounts the ladder 10, the rod 84 retracts and the spring 88 assumes its original positions. The fall arresting and damping arrangement thus is conveniently designed with a usable, recovery structure which can be relied upon in the event of a future fall without the need to replace any components of the arrangement 22.

Figure 3:
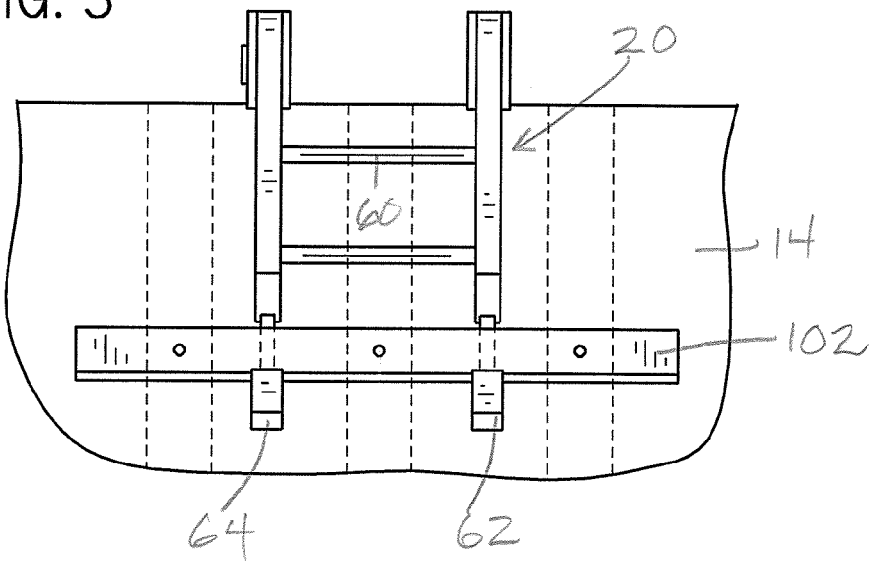
FIG. 3 is an enlarged view of a hang ladder section of the ladder of FIG. 1 secured to the inclined roof.
Figure 4:
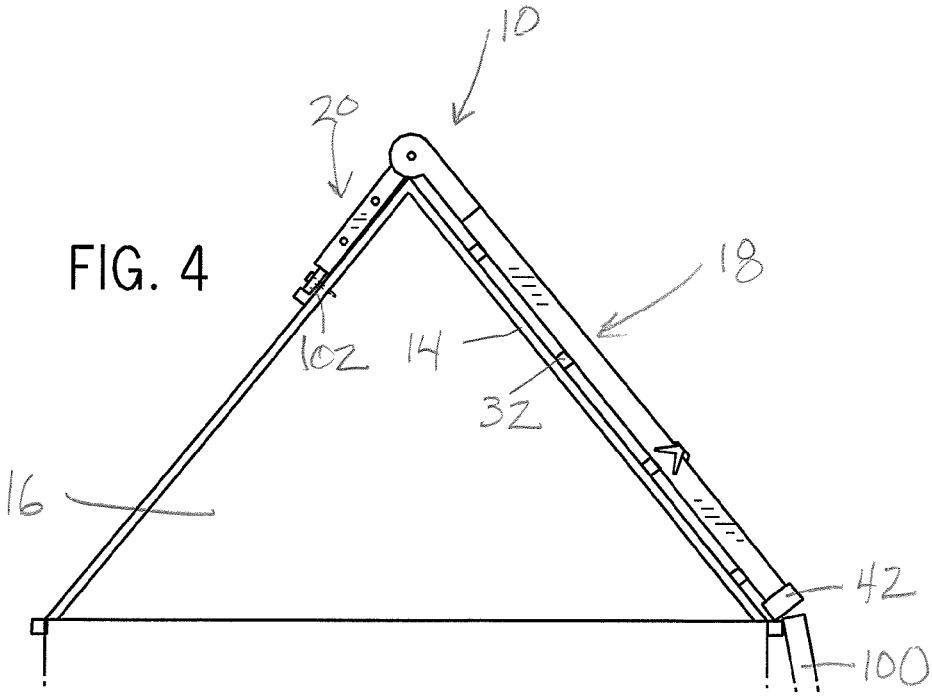
FIG. 4 is a side view of FIG. 1.

In use, and shown in FIG. 1, a roofer R will normally place a separate conventional ladder 100 against the siding of a home or building 16. In one exemplary installation, a roofer R first sets the length of the main section 18 and locks the hang ladder insert 48 in a selected angular position relative to the attachment section 46 based on the prevailing inclination and length of the roof 14. Then, the roofer R carries the relatively lightweight ladder 10 (which typically weights about 40-50 lbs.) up the conventional ladder 100, and places the ladder 10 on one side of the inclined roof 14 with the hang ladder insert 48 oriented upwardly away from the roof 14 until the peak 12 of the roof 14 is reached. At this point, the roofer R can flip the ladder 10 so that it is effectively hooked over the peak 12 and can positively anchor the ladder 10 to the other side of the inclined roof 12 by placing a retaining member, such as a board 102, across the extensions 62, 64 and nailing or otherwise fixing the board 102 as illustrated in FIG. 3. The foot pegs 42 on the inner ladder 38 can be safely engaged against the gutter 44 as the weight of the ladder 10 and the roofer R positioned therein is borne chiefly by the locked and secured hang ladder insert 48. Once the ladder is positioned on the roof 14, the roofer R wearing a harness 98 attaches the lanyard 96 to the eye hook 94 of the fall arresting and damping arrangement 22. Various known support brackets for holding roofing tiles or the like may be adjustably attached to the ladder 10 as desired.

Figure 6:
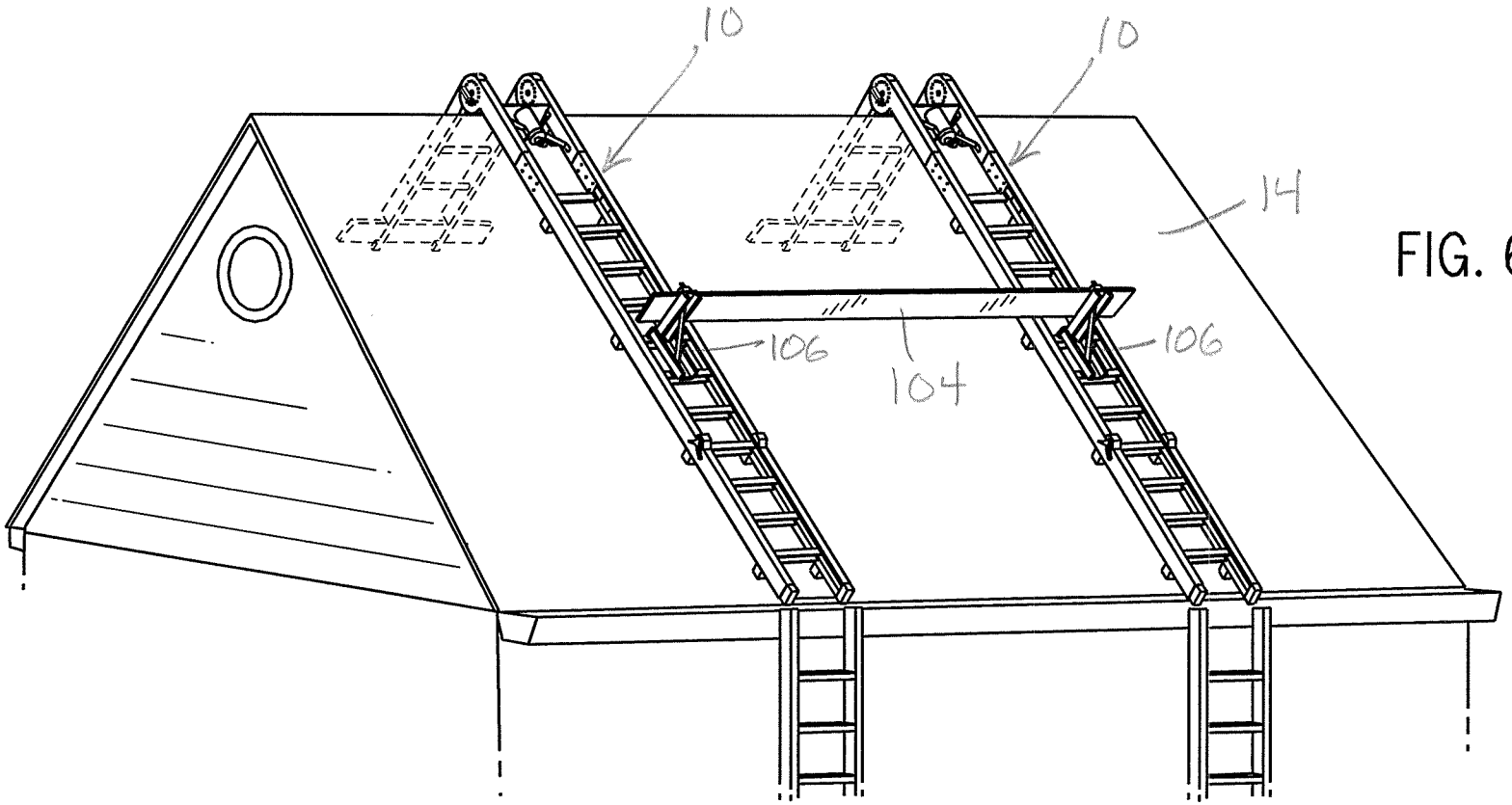
FIG. 6 is a representation of a pair of spaced apart adjustable hang ladders used on an inclined roof.

FIG. 6 illustrates the use of a pair of spaced apart ladders 10 installed on a roof 14 and interconnected by a plank 104 which can be retained by suitable support brackets 106.

Various alternatives are contemplated as being within the scope of the following claims particularly pointing out and distinctly claiming the subject matter regarded as the invention.

What is claimed is:

1. An adjustable hang ladder adapted to be used by a roofer on an inclined roof comprising:

a main ladder section having an outer ladder and an inner ladder slidably received relative to the outer ladder so that the inner ladder is movable between retracted and extended positions relative to the outer ladder to change a length of the main ladder section, the inner ladder being selectively locked relative to the outer ladder by a first locking mechanism on the outer ladder, the outer ladder and the inner ladder each having side rails interconnected by a plurality of rungs;

a hang ladder section having an attachment section secured to an upper end of the outer ladder and a hang ladder insert pivotally attached to the attachment section so that the hang ladder insert is movable to various angular positions relative to the attachment section, the upper end of the attachment section being provided with a second locking mechanism for fixing the hang ladder insert at a particular angular position relative to the attachment section, the attachment section and the hang ladder insert having side rails interconnected by a plurality of rungs; and a fall arresting and resilient damping arrangement fixedly mounted on the hang ladder section and designed for connection to the roofer for providing a cushioning effect in the event the roofer falls from the ladder, wherein the fall arresting and resilient damping arrangement includes a cushioning cylinder assembly movable between extended and retracted positions.

2. The ladder of claim 1, wherein the outer ladder is provided with spacers adapted to space the main ladder section from the roof.

3. The ladder of claim 1, wherein a bottom end of the inner ladder is provided with foot pegs adapted to engage a gutter on a roof.

4. The ladder of claim 1, wherein the side rails of the hang ladder insert are provided with extensions adapted to receive a retaining member which is transversely positioned across the extensions and attached to the roof.

5. The ladder of claim 1, wherein the cushioning cylinder assembly is attached to a mounting plate interconnected between the side rails of the attachment section.

6. The ladder of claim 1, wherein the cushioning cylinder assembly is further attached to a pair of mounting braces secured to the side rails of the attachment section.

7. The ladder of claim 1, wherein the cushioning cylinder assembly is located on the attachment section beneath the second locking mechanism.

8. The ladder of claim 1, wherein the cushioning cylinder includes a housing have an open end;

a spring arrangement contained in the housing;

an extendible and retractable rod passing through the spring arrangement and having an eye hook at one end of the rod; and a cap connected to the open end of the housing for retaining the spring arrangement and the rod in the housing with the eye hook extending outside the cap.

9. The ladder of claim 1, wherein the cushioning cylinder assembly is located between the second locking mechanism and an uppermost rung of the main ladder section.

* * * * *